United States Patent [19]

Petutschnig

[11] Patent Number: 5,000,445

[45] Date of Patent: Mar. 19, 1991

[54] SKATEBOARD APPARATUS WITH GRIPPING FRAME

[76] Inventor: Hubert Petutschnig, A-2454 Trautmannsdorf 100, Austria

[21] Appl. No.: 314,539

[22] Filed: Feb. 22, 1989

[30] Foreign Application Priority Data

| | | | |
|---|---|---|---|
| Apr. 25, 1988 | [AT] | Austria | 1042/88 |
| May 25, 1988 | [AT] | Austria | 1374/88 |
| Dec. 6, 1988 | [AT] | Austria | 2987/88 |

[51] Int. Cl.[5] ..... A63B 1/00

[52] U.S. Cl. ..... 272/115; 280/206; 280/87.041

[58] Field of Search ..... 272/70, 115; 280/87.01, 280/87.041, 87.042, 206, 207, 208

[56] References Cited

U.S. PATENT DOCUMENTS

| | | | |
|---|---|---|---|
| 2,330,147 | 9/1943 | Rodriguez | 280/87.041 |
| 4,302,006 | 11/1981 | Johnson | 280/206 |
| 4,466,372 | 8/1984 | Rudloff | 280/87.042 |

*Primary Examiner*—Stephen R. Crow
*Attorney, Agent, or Firm*—Herbert Dubno

[57] ABSTRACT

A skateboard-type sports apparatus has a frame forming a grip for the user and provided internally with a standing surface beneath which a pair of roller elements can be provided. The roller elements are rotatable in respective holders which can be rectangular frame members pivotally mounted on the frame so that a pin and an eyelet on opposite sides of each member define a pivot line for the roller. The rollers can thus pivot in planes substantially perpendicular to a central plane of the frame.

9 Claims, 4 Drawing Sheets

SKATEBOARD APPARATUS WITH GRIPPING FRAME

FIELD OF THE INVENTION

The invention relates to a sports apparatus, comprising a frame, especially an annular, elliptical or polygonal frame, which is movable on a bearing surface.

OBJECT OF THE INVENTION

The object of the present invention is to provide a sports apparatus which can be moved in a manner similar to that of a skateboard, changes in direction being effected by weight shifts, and which has the advantage over a skateboard that it is constructed with a gripping surface which is gripped by the user.

SUMMARY OF THE INVENTION

This object is attained according to the invention in that there are arranged on the frame two rollers, rolls, pairs of wheels or other roller elements whose bearing axles are swivelable about pivot axes with respect to the frame in a plane approximately perpendicular to the central plane of the frame.

Such a sports apparatus is used as follows: the user steps onto the inner surface of the frame in the area of the rollers and grasps the opposing area of the frame with one hand, the frame, which occupies a position somewhat inclined with respect to the vertical, being movable by means of roller elements. Since the position of the rollers, which are swivelable with respect to the frame, can be controlled by weight shifts, changes in direction can thereby be effected while the frame is moving.

The frame is preferably constructed in the area of the roller elements with a standing surface on its inside.

According to further preferred features, two bearing devices for the roller elements are provided on the frame. The rollers or the like are supported on these devices which are swivelable with respect to the central plane of the frame. These bearing devices can be constructed on the one side with a pin or the like which projects into an associated recess in the frame and on the other side with an eyelet or the like which is penetrated by a bolt attached to the frame, a spring member being arranged between the belt and the bearing device. By means of such a bearing device attachment, the device can be swivelled around the axis of the pin by means of the pin projecting into the recess. The swivelling is limited by the bolt penetrating the eyelet and the spring member acting against the swivelling or effecting the resetting of the bearing device.

At the same time the bearing device is preferably constructed as an approximately rectangular bearing frame, in whose lateral bars are accommodated the roller elements which are located inside the frame. From cross bars of the frame, the eyelet projects on the one side of the pin and on the other side thereof. The spring member can be formed by at least one elastically deformable sleeve, this sleeve preferably being constructed with grooves on its outer surface.

According to another preferred feature, the pin forms an acute angle of preferably approximately 60° with the central plane of the bearing device and the standing area or surface forms an acute angle preferably of 5° to 20° with the central plane of the frame.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
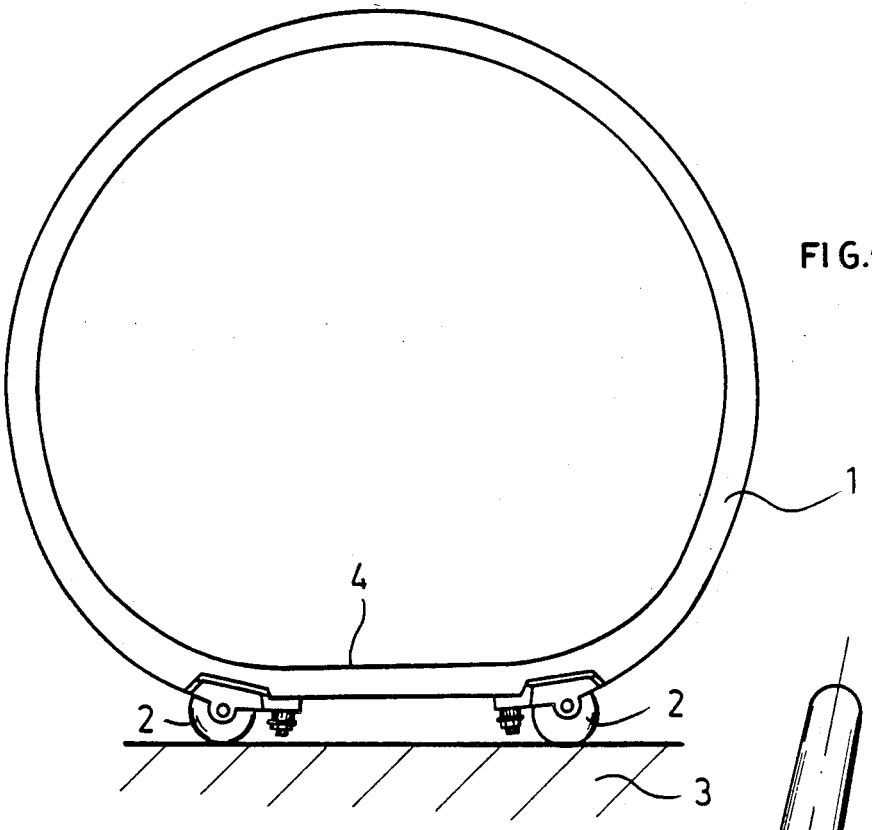
FIG. 1 is a side view of a sports apparatus according to the invention.
Figure 2:
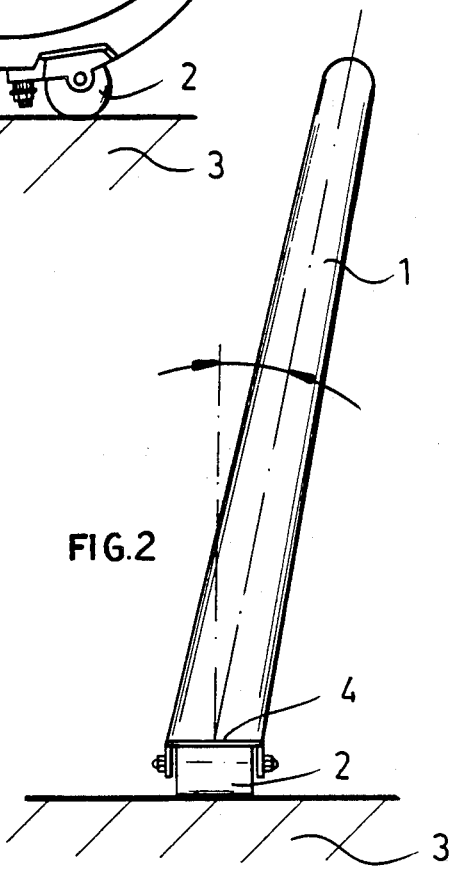
FIG. 2 is a front view of the sports apparatus according to the invention.

The sports apparatus shown in FIGS. 1 and 2 comprises an annular frame 1, which is displaceable on a supporting surface 3 by means of two roller elements 2, i.e. rollers or rolls. In the area of the rollers 2, the frame 1 is constructed on its inside with a standing or surface area 4, whose normal plane, as may be seen from FIG. 2, forms an acute angle of approximately 10° with the central plane of the frame which is inclined to the vertical when the surface 3 is horizontal.

Since the rollers 2 are pivotable on the frame 1 in a plane perpendicular to the central plane of the frame, the position of the rollers 2 can be altered with respect to the frame 1 by weight shifts, whereby while the frame 1 is moving changes in direction can be achieved by means of the rollers 2.

Figure 3:
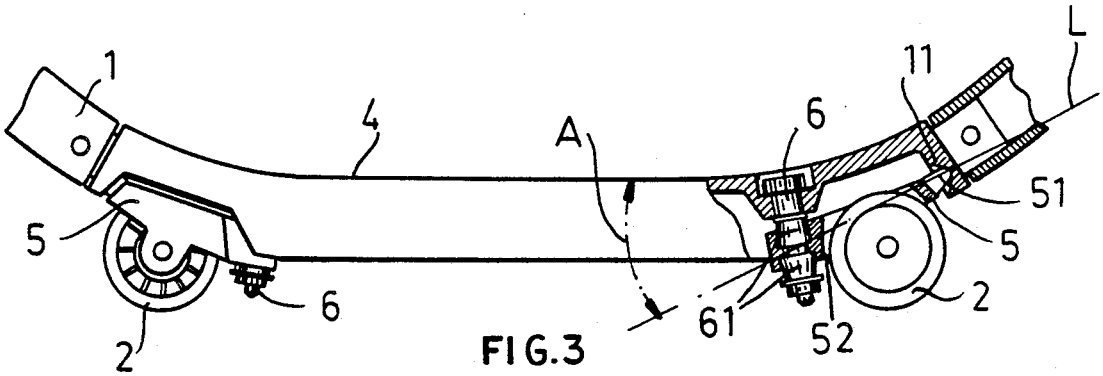
FIG. 3 is a detail view, partly broken away, of the sports apparatus according to the invention.
Figure 4:
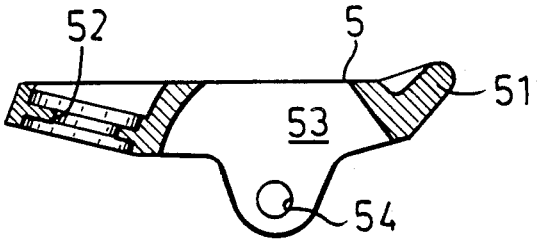
FIG. 4 is a longitudinal section of the bearing device.
Figure 5:
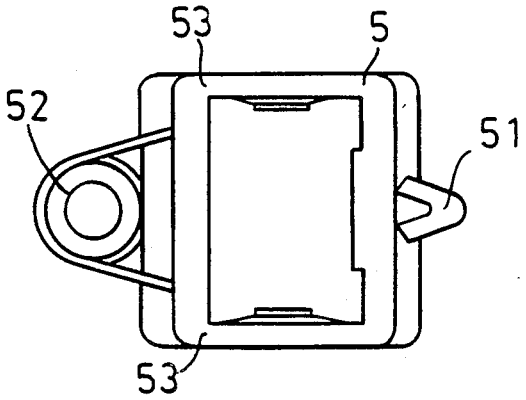
FIG. 5 is a plan view of the bearing device.

As may be seen from FIGS. 3 to 5, the rollers 2 are accommodated in bearing frames 5 and each bearing frame 5 is constructed with a projecting pin 51 which projects into an associated recess 4 in the frame. At the opposite side the bearing frame 5 is constructed with an eyelet 52, through which passes a bolt 6 attached to the frame 1, two resilient spring sleeves 61 being arranged between the bolt 6 and the eyelet 52. Owing to this securing of the bearing frame 5, the latter can pivot with respect to the frame 1 approximately around the axis of the pin, the swivel angle being restricted by the bolt 6 passing through the eyelet 2 and the necessary resetting force being provided by the spring members 61.

In view of the somewhat inclined position of the frame 1, the recesses 11 are slightly offset with respect to the central plane of the frame 1 on the side towards which the frame 1 is inclined. In order to be able to effect steering of the frame 1 during its movement by weight shifts, the connecting line L of the pin 51 and the eyelet must form an acute angle A, amounting to approximately 10° to 45°, preferably 30°, with the standing area 4.

FIGS. 4 and 5 the bearing frame 5 is shown in cross section and plan view. The longitudinal bars are constructed as side pieces 53, which are provided with bearing bores 54 for the axles of the rollers 2. The pin 51 projects from the one cross bar and the other cross bar is constructed with the eyelet 52.

Figure 6:
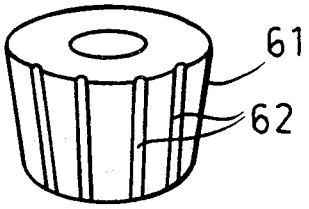
FIG. 6 is a perspective view of the spring member.

FIG. 6 is a perspective view of a resilient sleeve 61. As may be seen therefrom, this sleeve 61 is approximately conical in form and is provided in its outer surface with longitudinal grooves 62. The purpose of these grooves is to ensure the necessary resilience even when the bearing device 5 is at maximum deflection.

Figure 7:
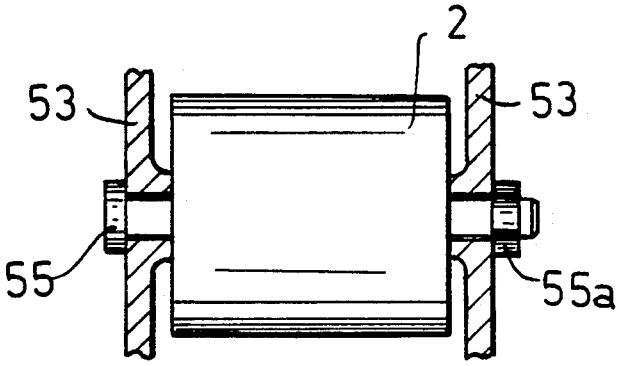
FIG. 7 to 9 are sectional views of different constructions of the support of the rollers in the bearing device.
Figure 8:
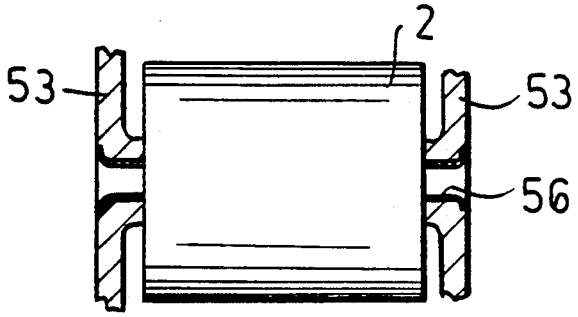
Figure 9:
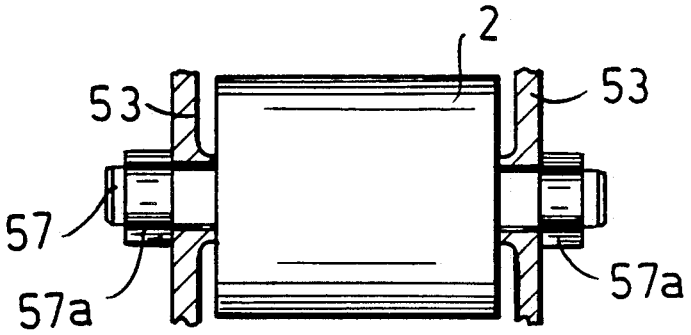

FIGS. 7 to 9 show variants of the secure accommodation of the rolls 2 in the bearing frame 5. In the embodiment according to FIG. 7 the bearing eyelets 54 in the side walls 53 of the bearing frame 5 are traversed by a set bolt 55, onto which is screwed a nut 55*a*. In the embodiment according to FIG. 8, a hollow rivet is inserted into the bearing eyelets. The roll 2 is supported on the rivet 56. In the embodiment of FIG. 9, the bearing eyelets are traversed by a bolt 57, onto which nuts 57*a* are screwed and secured.

Figure 10:
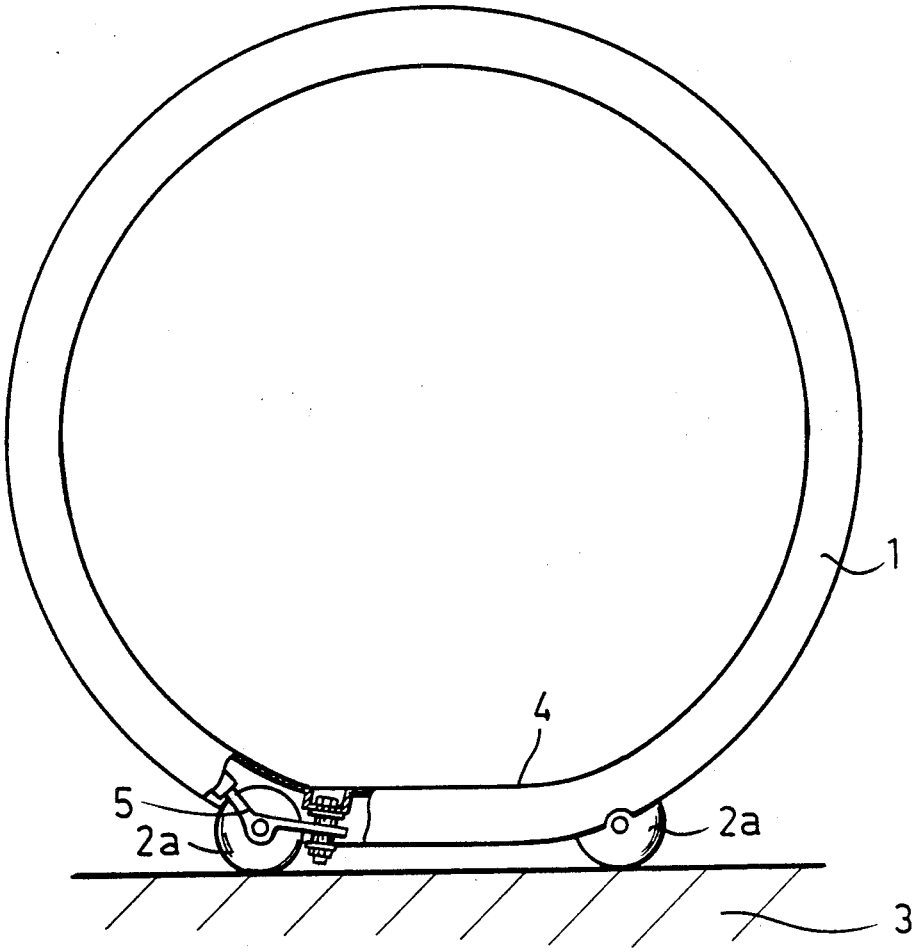
FIG. 10 is a side view, partly in section, of a second embodiment of a sports apparatus according to the invention.
Figure 11:
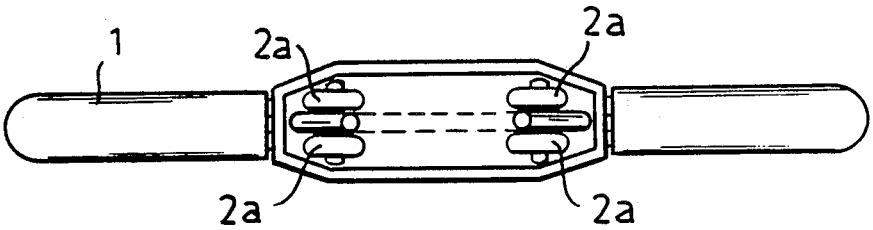
FIG. 11 is a view from below of the sports apparatus according to FIG. 10.

FIGS. 10 and 11 show an embodiment of the sports apparatus according to the invention which differs from the embodiment of FIGS. 1 to 3 in that two wheel 2*a* are accomodated in each bearing device 5.

The frame 1 can be produced in one piece or it can be composed of two hollow sections, which are constructed on their inner surface with reinforcing webs. The frame can have a variety of constructions, it being possible to construct it as a fantasy structure, an animal, etc.

I claim:

1. A sports apparatus comprising:

a generally annular frame which can be moved on a bearing surface and having a central plane of the frame;

two roller elements accommodated on the frame and having bearing axles and mounted on said frame; and means receiving said roller elements for rotation about said bearing axles and pivotable relative to said frame in a plane approximately perpendicular to the central plane of the frame, said frame being constructed on its inside with a user-standing area, said means receiving said roller elements comprising two bearing devices for the roller elements, in which the roller elements are supported and which are pivotable with respect to the central plane of the frame, each of the bearing devices being a bearing frame member formed on one side with a pin which projects into an associated recess formed in the frame, and on an opposite side with an eyelet which is traversed by a bolt fastened to the frame, a spring member being arranged between the bolt and the bearing frame member.

2. The sports apparatus defined in claim 1, wherein said bearing frame member is constructed as an approximately rectangular frame having side bars in which the roller elements are supported and from whose cross bars the pin and the eyelet project.

3. The sports apparatus defined in claim 1 wherein said spring member is formed by at least one elastically deformable sleeve.

4. The sports apparatus defined in claim 3 wherein the sleeve is formed with grooves on its outer surface.

5. The apparatus defined in claim 1 wherein said pin forms an acute angle of preferably approximately 60° with a central plane of the bearing frame member.

6. The sports apparatus defined in claim 1 wherein the standing area forms an acute angle of 5° to 20° with the central plane of the frame.

7. The sports apparatus defined in claim 1 wherein a connecting line between the pin and the eyelet forms an acute angle of approximately 30° with a user-standing area formed in said frame along an inside thereof above said roller elements.

8. The sports apparatus defined in claim 1 wherein said roller elements are rollers.

9. The sports apparatus defined in claim 1 wherein said roller elements are wheels.

* * * * *